US006108872A

United States Patent [19]

Nichols et al.

[11] Patent Number: 6,108,872

[45] Date of Patent: Aug. 29, 2000

[54] COTTON GIN WITH ROTARY RIB

[76] Inventors: Mark Nichols, HRC 1, Box 237; Billy Joe Price, Rte. 1, Box 205; Benny P. Nichols, 509 SW. Ave. J, all of Seminole, Gaines County, Tex. 79360

[21] Appl. No.: 08/950,961

[22] Filed: Oct. 15, 1997

Related U.S. Application Data

[60] Provisional application No. 60/028,137, Oct. 16, 1996.

[51] Int. Cl.[7] ..... D01B 1/08

[52] U.S. Cl. ..... 19/62 R; 19/62 A; 19/63

[58] Field of Search ..... 19/39, 48 R, 49, 19/50, 53, 54, 55 R, 57, 62 A, 62 R, 63, 64, 64.5

[56] References Cited

U.S. PATENT DOCUMENTS

| | | |
|---|---|---|
| 1,460,228 | 6/1923 | Cumpston . |
| 1,485,833 | 3/1924 | Cumpston . |
| 1,849,773 | 3/1932 | Streun . |
| 2,104,889 | 1/1938 | Streun . |
| 2,119,186 | 5/1938 | Streun . |
| 3,135,021 | 6/1964 | Jennings . |
| 3,136,003 | 6/1964 | Jennings . |
| 3,162,903 | 12/1964 | Wallace . |
| 3,163,889 | 1/1965 | Wallace . |
| 3,231,939 | 2/1966 | Deems . |
| 3,277,536 | 10/1966 | Van Doorn et al. . |
| 3,369,275 | 2/1968 | Headley . |
| 3,619,867 | 11/1971 | Hays . |
| 3,694,857 | 10/1972 | Nayfa . |
| 4,094,043 | 6/1978 | Vandergriff . |
| 4,153,976 | 5/1979 | Vandergriff . |
| 4,400,851 | 8/1983 | Hudson . |
| 4,433,454 | 2/1984 | Salmon et al. . |
| 4,457,049 | 7/1984 | Hudson . |
| 4,463,479 | 8/1984 | Nayfa . |
| 4,625,365 | 12/1986 | Nayfa . |
| 4,850,083 | 7/1989 | France . |
| 4,974,294 | 12/1990 | Vandergriff . |

*Primary Examiner*—Michael A. Neas
*Assistant Examiner*—Gary L. Welch
*Attorney, Agent, or Firm*—Locke Liddell & Sapp LLP; Monty L. Ross

[57] ABSTRACT

A rotary rib cotton gin includes a plurality of gin saw blades axially spaced and rotatably mounted in a gin stand. A ginning breast is pivotally mounted on the gin stand and includes a plurality of stationary ribs having a lower end fixed to the ginning breast, and an upper free end disposed between each adjacent gin saw blade when the ginning breast is in the operating position. The ginning breast further includes a rotary rib rotatably mounted in the ginning breast above the free end of the stationary ribs. The rotary rib includes a plurality of axially spaced rotary discs fixably mounted on a rotatable shaft, wherein an end portion of each rotary disc is disposed between each adjacent gin saw blade when the ginning breast is in the operating position.

4 Claims, 7 Drawing Sheets

COTTON GIN WITH ROTARY RIB

RELATED APPLICATION

This application claims priority from provisional application Ser. No. 60/028,137, filed Oct. 16, 1996.

TECHNICAL FIELD

The present invention relates generally to cotton gins and more particularly to a saw-type cotton gin with a plurality of stationary ribs for directing the cotton seeds downward away from the ginning point and a rotary rib comprised of a plurality of rotary rib discs for directing trash such as hulls and stems contained in the seed cotton roll upward and away from the ginning point.

BACKGROUND OF THE INVENTION

Cotton is a natural fiber grown on a cotton plant. The fibers (commonly referred to in the art as lint) grow in a boll on a stem of the cotton plant. Seeds are interspersed with the fiber in the boll. The lower part of the boll includes a dried portion of the envelope that contained the cotton bloom as it developed into the boll and is referred to in the art as a "burr." Most cotton in the United States is harvested ("stripped") by machines referred to in the art as "strippers." When the cotton boll is stripped from the plant by the stripper, the seeds are interspersed with the fiber and tightly bound to the hull of the seed. Mechanical strippers, while very efficient in harvesting the cotton, tend to collect burrs, leaves, stalks and other trash with the cotton bolls. Gins as well-known in the art for over 150 years have been used to mechanically separate cotton seeds from the lint. In conventional prior art gins, stationary ribs are alternately interspersed between gin saws to separate the seed from the lint and direct the seeds downward and away from the ginning point. One example of a gin with stationary ribs is illustrated in U.S. Pat. No. 4,433,454 issued to Salmon.

U.S. Pat. No. 3,315,021 issued to Jennings discloses a rotary rib gin which does not contain any stationary ribs. In the Jennings gin, the rotary ribs are disposed downwardly in relation to the seed cotton roll, which accumulates during the ginning process. The rotary ribs of the Jennings gin direct the trash (including seed, stems and burrs) upward toward the center of an accumulated seed cotton roll where the seeds and trash fall through a longitudinal slit in a seed conveyor cover and are removed by a spiral seed conveyor. In the Jennings gin, the seed, stems and burrs will tend to fall downwardly due to gravity and may repeatedly contact the rotary ribs and gin saws before entering the slit in the conveyor cover whereby they are removed from the gin. In addition to being inefficient, such repeated contact may contribute to trash lodging between the gin saw blades and the rotary ribs which may result in a gin fire.

One of the most serious problems in prior art gins are rib fires. Rib fires are caused when trash such as cotton hulls, burrs, stems, and/or green or wet cotton seed lodge in between a gin saw blade and the ribs disposed on each side of the gin saw blade. The gin saw blade may rotate at speeds of approximately 700 RPM. Friction between the gin saw blade and the trash will cause a build up of heat. The cotton lint is very flammable. A rib fire occurs when the heat builds to the point of spontaneous combustion.

Rib fires are very dangerous and destructive. A need exists in the ginning industry for a gin design that efficiently prevents trash from lodging between the ribs and the gin saw blades. The rotary rib of the present invention effectively prevents trash and cotton seeds from lodging between the gin saw blades and the ribs.

SUMMARY OF THE INVENTION

The present invention comprises a rotary rib cotton gin including a plurality of gin saw blades axially spaced and rotatably mounted in a gin stand. A ginning breast is pivotally mounted on the gin stand and includes a plurality of stationary ribs having a lower end fixed to the ginning breast, and an upper free end disposed between each adjacent gin saw blade when the ginning breast is in the operating position. The ginning breast further includes a rotary rib rotatably mounted in the ginning breast above the free end of the stationary ribs. The rotary rib includes a plurality of axially spaced rotary discs fixably mounted on a rotatable shaft, wherein an end portion of each rotary disc is disposed between each adjacent gin saw blade when the ginning breast is in the operating position.

As the gin saw blades are rotated at approximately 730 RPM, the saw blades pull the seed cotton into contact with the rotary rib. This contact point is known in the art as the ginning point. The gin saw blade pulls the lint from the seed cotton and carries the lint on the saw blade until it contacts a cylindrical shaped doffing brush which is mounted on a rotatable shaft. The doffing brush pulls the lint from the saw blade wherein a suction means evacuates the lint from the doffing brush and blows the lint to a bailer for further processing.

Seeds are separated from the seed cotton by the rotary rib and are directed downward and away from the inlet cotton by the stationary ribs. The seeds are removed by a seed conveyor.

In operation, the rotary rib is rotated at approximately 65 RPM and picks up trash comprised of immature green cotton seeds, burrs, stems, stalks and leaves and carries the trash up and away from the ginning point, thereby preventing trash from lodging between the rolling ribs and the saw blades and causing a gin fire. The trash carried from the ginning point by the rotating rib falls due to gravity and is directed by the stationary ribs out of the gin stand with the ginned seeds.

BRIEF DESCRIPTION OF THE DRAWINGS

A more complete understanding of the present invention may be had by reference to the following Detailed Description when taken in conjunction with the accompanying drawings wherein.

DETAILED DESCRIPTION OF THE INVENTION

Figure 1:
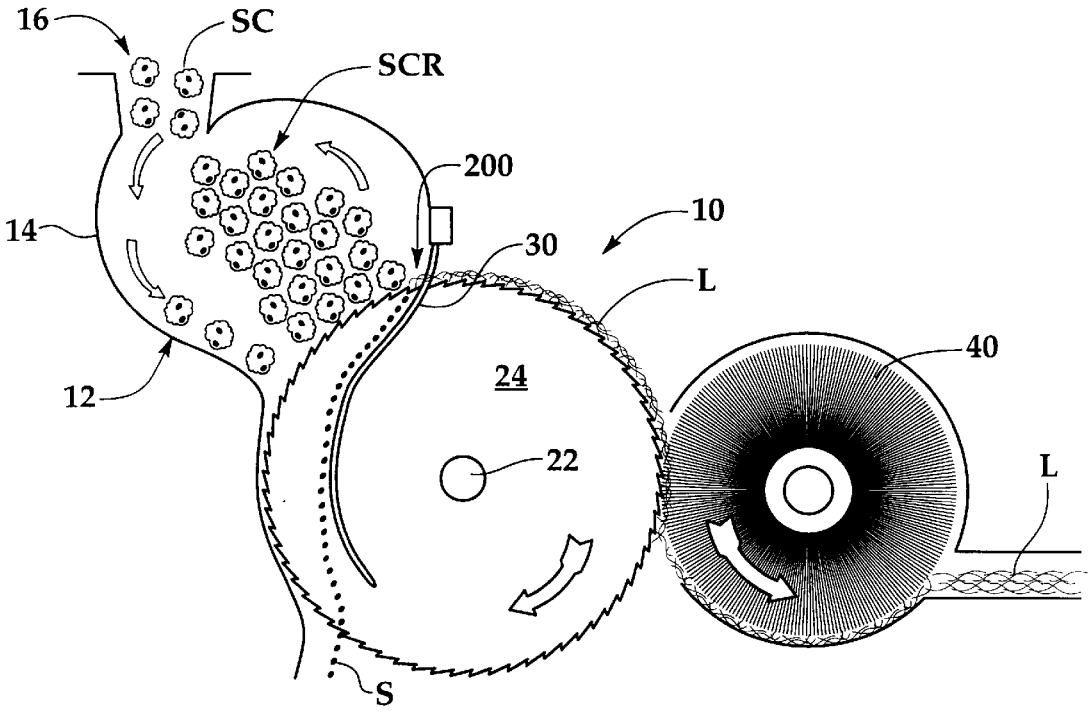
Fig.1 (PRIOR ART)
FIG. 1 is a schematic of a prior art conventional stationary rib gin.

Reference is now made to the Drawings wherein like reference characters denote like or similar parts throughout the Figures.

Referring to FIG. 1, wherein there is illustrated the basic elements and configuration for a prior art stationary rib cotton gin 10 in its simplest form. Seed cotton SC is harvested in the field and delivered to the gin in conventional trailers. The seed cotton SC is processed by conventional precleaning equipment (not shown) which removes most, but not all, of the trash, including stalks and burrs from the seed cotton. The pre-cleaned seed cotton SC is fed by a conventional feeder (not shown) into an inlet cotton chute 16 of a gin stand 12. A gin saw 20 is comprised of a plurality of gin saw blades 24 fixably mounted on a rotatable shaft 22. A stationary rib 30 is positioned between each gin saw blade 24. The spacing between the blade 24 and the 30 rib is ideally less than the diameter of a typical cotton seed S. As the gin saws blades 24 are rotated, the saw blades pull the seed cotton SC into contact with the stationary rib 30. This contact point is known in the art as the ginning point 200. The saws 20 pull the lint L from the seed cotton SC and carry the lint on the blade 24 until it contacts a cylindrical shaped doffing brush 40. The doffing brush 40 pulls the lint L from the saw blade 24, wherein a suction means evacuates the lint from the doffing brush 40 and blows the lint to a bailer for further processing. Seeds S are separated from the seed cotton SC and are directed downward and away from the inlet cotton by the stationary ribs 30. The seeds S are removed by a seed conveyor (not shown). As the seed cotton SC contacts the gin saw blades 24, some of the seed cotton is thrown upward away from the rotating blade 24. The cotton is contained by a seed cotton roll box 14. The seed cotton SC will form a longitudinal seed cotton roll SCR which will rotate counter to the rotation of the gin saw 20.

Figure 2A:
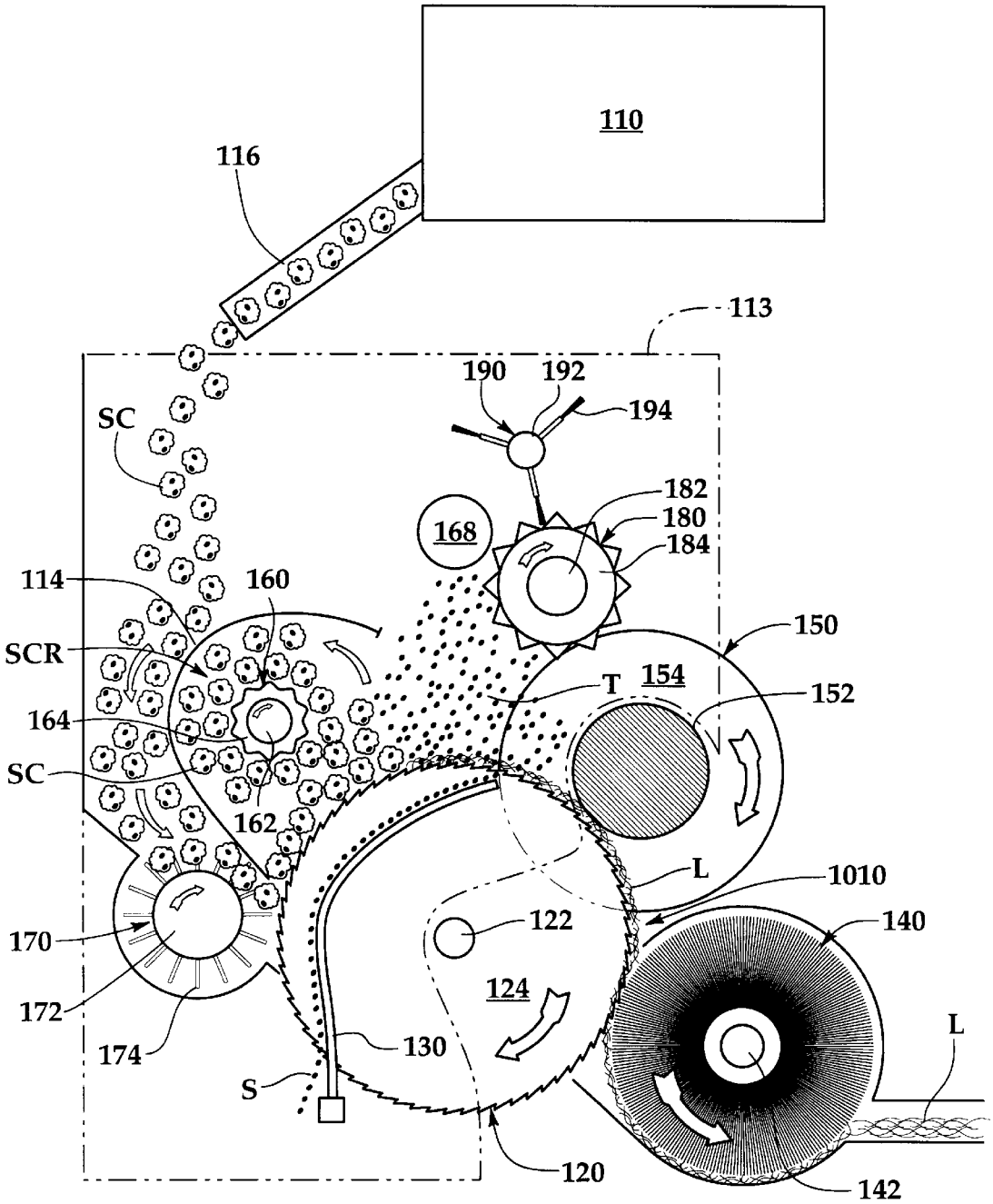
FIG. 2A is a schematic of a cotton gin with rotary rib discs of the present invention.

Referring now to FIG. 2A, therein is illustrated a schematic of a rotary rib cotton gin 100 of the present invention. As described above with regard to the prior art gin 10, seed cotton SC is harvested in the field and delivered to the gin in conventional trailers. The seed cotton SC is processed by pre-cleaning equipment 110 which removes most, but not all, of the trash including stalks and burrs from the seed cotton. In the present invention, the pre-cleaned seed cotton SC is fed from the pre-cleaner 110 into an inlet cotton chute 116 (sometimes referred to in the trade as an "apron"). Unginned seed cotton SC is engaged by longitudinal feeder roller 170 which rotates approximately 298 RPM. A plurality of one-inch long spikes 174 are mounted on a three-inch outside diameter wooden sleeve which is mounted on a rotatable one-inch steel shaft 172. The spikes 174 engage the unginned seed cotton SC and direct the seed cotton in contact with a gin saw 120 comprised of a plurality of gin saw blades 124.

In the preferred embodiment, the gin saw 120 is comprised of ninety gin saw blades 124 that are fixably mounted on a rotatable shaft 122. The diameter of the gin saw blades 124 is approximately 12 inches and they rotate at approximately 730 RPM. A stationary rib 130 comprising a bar of ⅝ inch diameter, with a generally circular cross section, is positioned between each gin saw blade 120. Additionally, a stationary rib is positioned on the outer side of the outer end gin saw blades 124, thereby totaling ninety one stationary ribs. The spacing tolerance between each blade 120 and each rib 130 is ideally less than the diameter of a typical cotton seed S. In the preferred embodiment of the invention, the gin saw blade 124 has a width less than ⅛th inch. The tolerance between the rib and the blade is generally one blade width on each side.

In a conventional gin without a rotary rib, trash T such as cotton hulls, burrs, stems, stalks not removed by the pre-cleaner 110, and/or green or wet cotton seeds may become wedged between a gin saw blade 124 and the adjacent stationary ribs 130 and catch lint to form wad. Such a wad may increase the drag on the gin saws requiring more power input into the gin and/or result in a gin fire.

The present invention includes a rotary rib 150 comprised of a series of ninety-one axially spaced rotary rib discs 154 mounted on a rotatable shaft 152. In the preferred embodiment, the rotary rib discs 154 are integrally formed with the shaft. The rotary rib discs 154 may be formed by machining a billet of aluminum alloy into a cylinder having an outer diameter of approximately 9.65 inches. Ninety slots 155 spaced axially on the tube may be machined a depth $D_1$ of approximately 2.5 inches, thereby forming ninety-one integral rotary rib discs 154. A rotary rib disc 154 is positioned between each gin saw blade 124 and one on the outer side of each end saw blade. Each of the rotating rib discs aligns with and is disposed above a corresponding stationary rib. It will be understood by those skilled in the art that the present invention may include more or less than ninety saw blades. However, in the preferred embodiment, the stationary ribs and the rotary rib discs will number one more than the total of the gin saw blades 124 and the total stationary ribs will be equivalent to the total rotary rib discs.

Figure 2B:
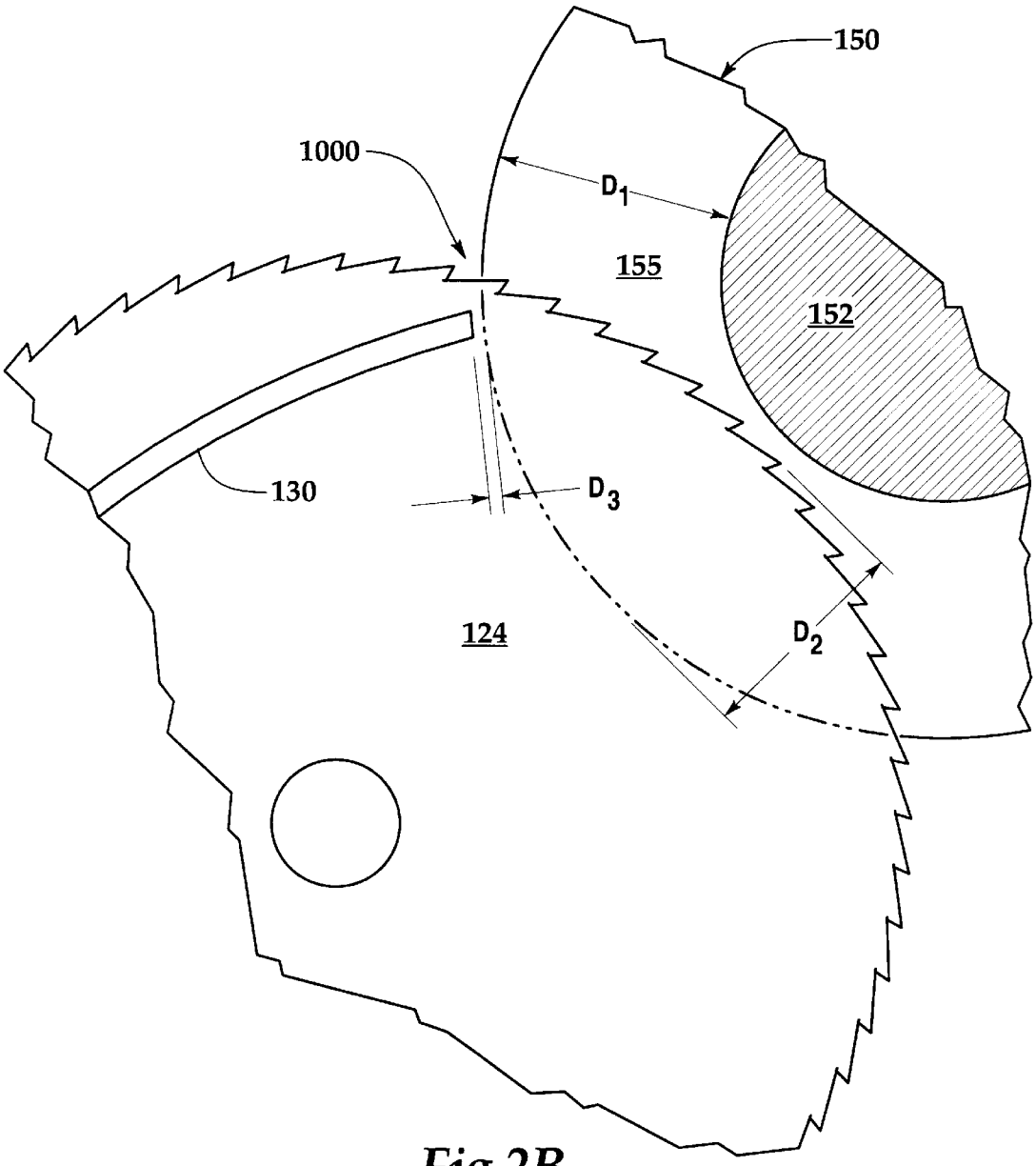
FIG. 2B is an enlarged portion of FIG. 2A illustrating the ginning point in detail.

As illustrated in FIGS. 2A and 2B, when the gin is in an operating mode, the gin saw blades 124 penetrate a distance $D_2$ of approximately 2 inches into the slot 155 between the rotary rib discs. The lateral spacing tolerance between each blade 124 and each rotary rib 150 is ideally less than the diameter of a typical cotton seed S and in the preferred embodiment is equivalent to the width of a gin saw blade 124. It will be understood that it is not necessary for the practice of the present invention to form the rotary ribs discs 154 integrally, but the rotary rib discs 154 may be formed separately and then assembled to a shaft 152 with the appropriate spacing therebetween.

Referring in particular to FIG. 2B, as the gin saw 120 is rotated at approximately 730 RPM, the saw blades pull the seed cotton SC into contact with the rotary rib 150. This contact point 1000 is known in the art as the ginning point 1000. Referring to FIG. 2A, the gin saw blade 124 pulls the lint L from the seed cotton SC and carries the lint L on the blade 124 as indicated by arrow 1010 until it contacts a cylindrical shaped doffing brush 140 which is mounted on a rotatable shaft 142. The doffing brush 140 pulls the lint L from the saw blade 124 wherein a suction means evacuates the lint L from the doffing brush 140 and blows the lint L to a bailer for further processing. The diameter of the doffing brush 140 is approximately nine inches and rotates at approximately 1880 RPM. Seeds S are separated from the seed cotton SC by the rotary rib 150 and are directed downward and away from the inlet cotton by the stationary ribs 130. The seeds S are removed by a seed conveyor (not shown). Referring to FIG. 2B, the stationary rib 130 includes a free end 132 having a beveled end. The gap $D_3$ between the end of the stationary rib 130 and the rotary rib 150 is approximately ⅛ of an inch.

Referring again to FIG. 2A, as the seed cotton SC contacts the gin saw 120, some of the unginned seed cotton SC is thrown upward away from the rotating blades 124. The cotton is contained in the gin stand 112 by a seed cotton roll box 114. The seed cotton will form a longitudinal seed cotton roll SCR. A seed roll agitator 160 comprising spiral blades 164 mounted on a rotatable shaft 162 is disposed in the seed roll box for evenly dispersing the seed cotton roll SCR along the plurality of gin saw blades 124 and for preventing the seed roll from becoming stagnate; i.e., to keep the seed cotton from falling out of the roll down onto the gin saws and to prevent accumulation of trash and ginned seed in the roll. The seed roll agitator 160 is rotated at approximately 170 RPM in the opposite direction from the rotation of the gin saw blade 124 thereby forcing the seed roll back in contact with the gin saw 120 and preventing the SCR from becoming stagnate. A press roller 168 comprised of a freely rotating cylinder of approximately 2.5 inches in diameter helps to hold the seed cotton roll SCR in position in the seed cotton roll box 114.

In operation, the rotary rib 150 is rotated at approximately 50 RPM and picks up trash T comprised of immature green cotton seeds, burrs, stems, stalks and leaves and carries the trash T up and away from the ginning point 1000 thereby preventing trash from lodging between the rotary rib discs 154 and the nine inch saw blades 124.

The trash T carried from the ginning point 1000 by the rotating rib 150 falls due to gravity and is directed by the stationary ribs 130 out of the gin stand 112 with the ginned seeds S. Any trash retained between the rotary rib discs 154 is removed from the rotary rib 150 by a twelve star roller 180.

The twelve star roller 180 includes ninety twelve star plates 184 mounted on a rotatable shaft 182, one plate 184 for each slot 155 in the rotating rib 150. The diameter of a twelve star plate 184 is approximately 4.5 inches and each one of the twelve points of the star projects approximately ½ inch from the plate 184. The twelve star roller 180 rotates at approximately 120 RPM. The points of the star plate 184 pull trash T from the slots 155 of the rotary rib 150. A sweeper brush 190, including one-inch bristles 194 mounted in a one-inch wooden bar mounted on a round metal rotatable bar 192 of approximately 1.5 inch diameter, brushes any trash T retained on the star plates 184 back into the seed cotton roll box 114 where the trash will fall downward and again contact the seed roll where it will again engage the gin saw blades 124 again and will be directed by the stationary ribs 130 out of the gin stand 112 with the ginned seeds S. The sweeper brush 190 rotates at approximately 73 RPM.

Figure 3:
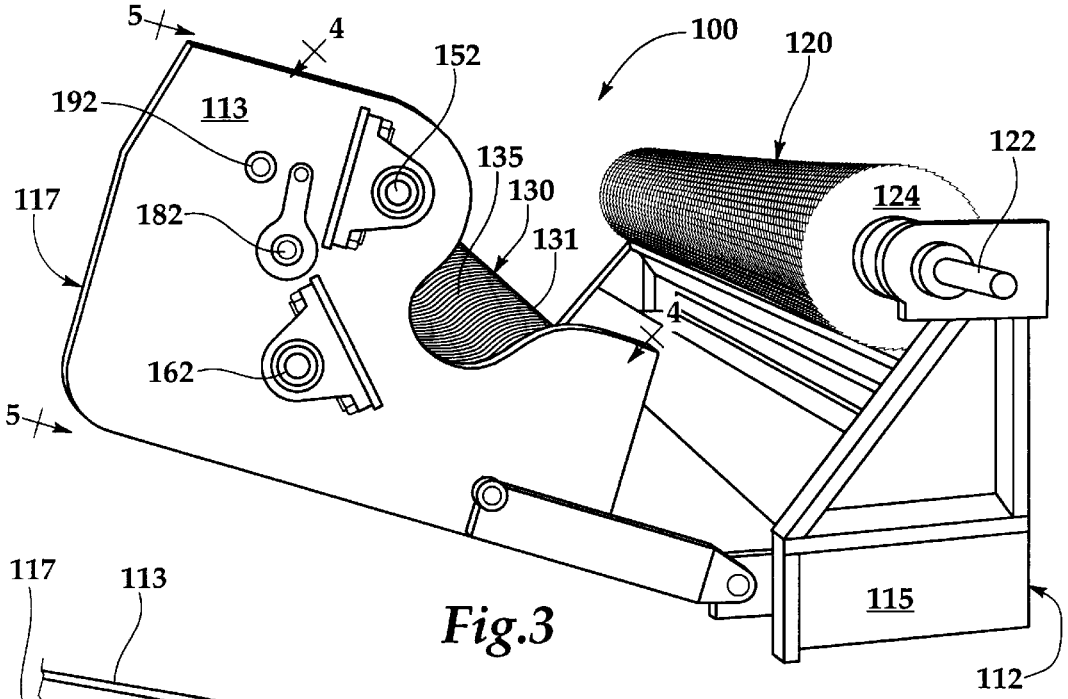
FIG. 3 is a perspective view of the cotton gin of the present invention with a ginning breast illustrated in a laid open position.
Figure 4:
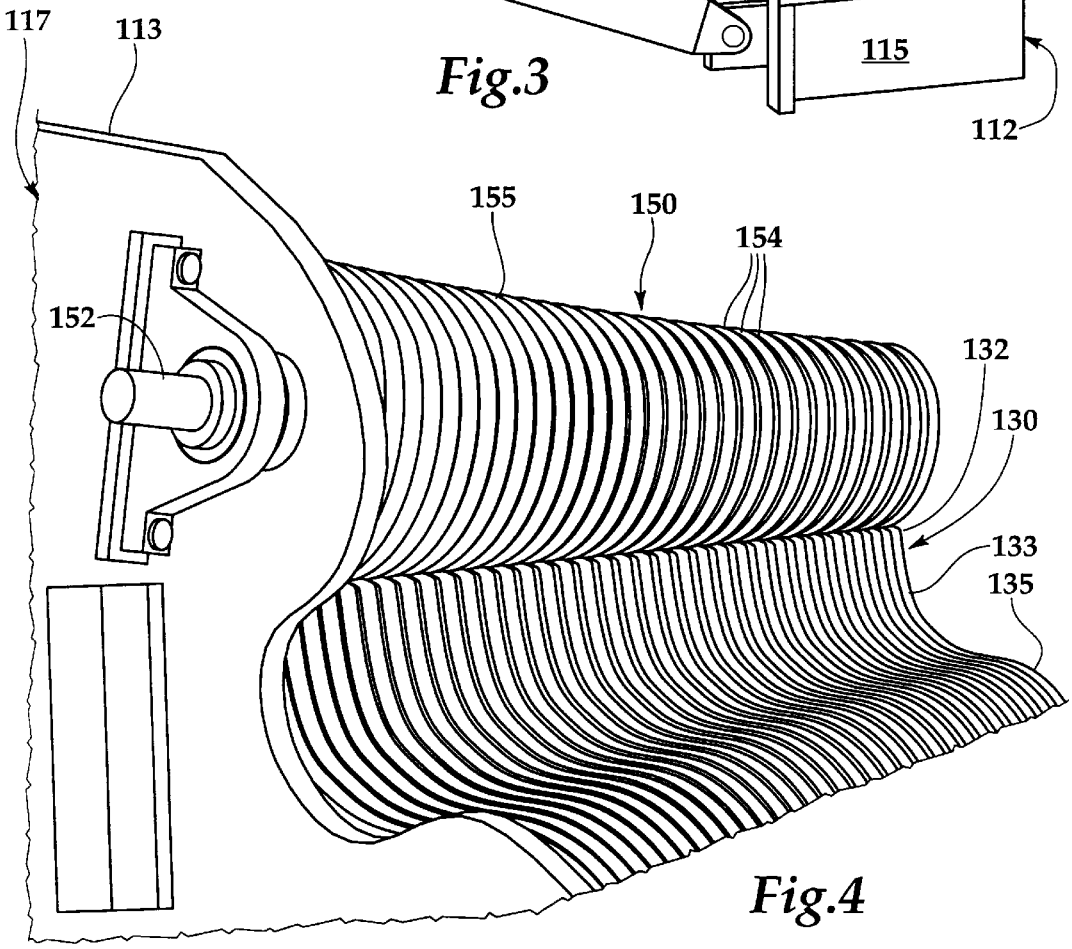
FIG. 4 is a perspective view of the rotary rib discs and stationary ribs of the ginning breast of FIG. 3.

Referring now to FIGS. 3 and 4 wherein there is illustrated the rotary rib cotton gin 100 of the present invention with a ginning breast 117 rotated in an open position to more fully illustrate the elements of the present invention. The gin stand 112 is comprised of the stationary gin stand frame 115 and the forwardly movable ginning breast 117. In the preferred embodiment of the invention, the gin saw 120 comprised of ninety gin saws blades 124 is mounted on the rotatable shaft 122 which is journaled in the gin stand frame 115.

The ginning breast 117 includes a pair of end plates 113, one disposed at each end of the ginning breast 117. Ninety-one stationary ribs 130 are bolted at a lower fixed end 131 to the ginning breast 117. Each stationary rib 130 includes an arcuate section 133 having a radius of curvature less than the radius of curvature of the gin saw blades 124. Each stationary rib 130 further includes a reverse arcuate section 135 curving away from the curvature of the gin saw 120 for directing ginned seed downward and away from the ginning point 1000 (see FIG. 2A).

The ginning breast 117 further includes the rotary rib 150, comprised of ninety-one rotary rib discs 154 mounted on the rotatable shaft 152 journaled into the end plates 113 of the ginning breast 117. The slot 155 between the rotary ribs 154 is in alignment with the space between the individual stationary ribs 130. When the ginning breast 117 is rotated forward, an individual gin saw blade 124 will pass therebetween each stationary rib 130 and in the slot 155 between each rotary rib disc 154.

Figure 5:
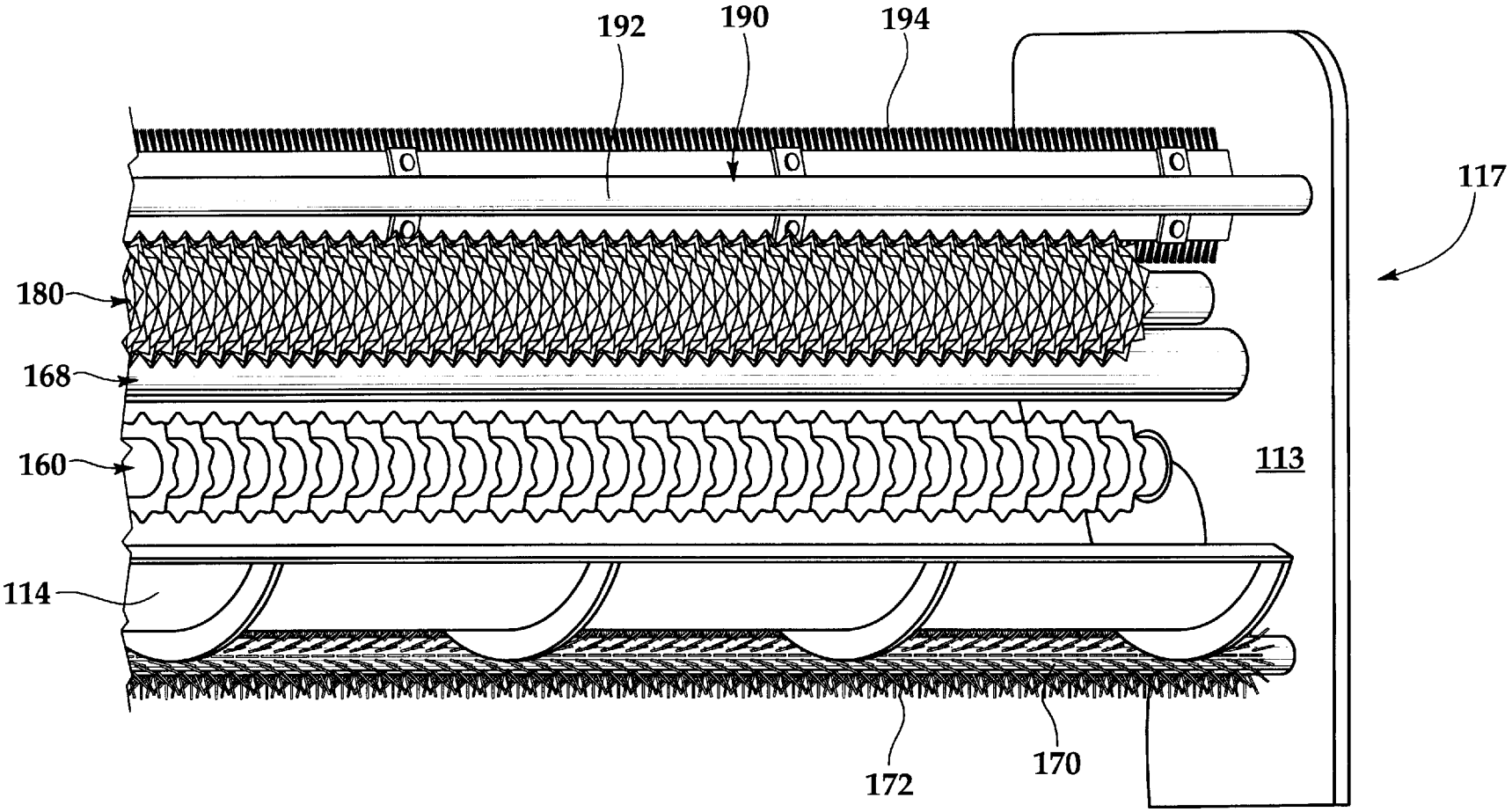
FIG. 5 is a perspective view of the gin of the present invention with the seed cotton roll box in an open position.

Referring now to FIG. 5, therein is illustrated the ginning breast 117 as seen from the rear when the breast is in the open position. The seed roll box 114 is rotated downward in an open position to illustrate the seed roll agitator 160 and the twelve star roller 180 and the press roller 168. The sweeper brush 190 can be seen above the press roller 168.

Figure 6:
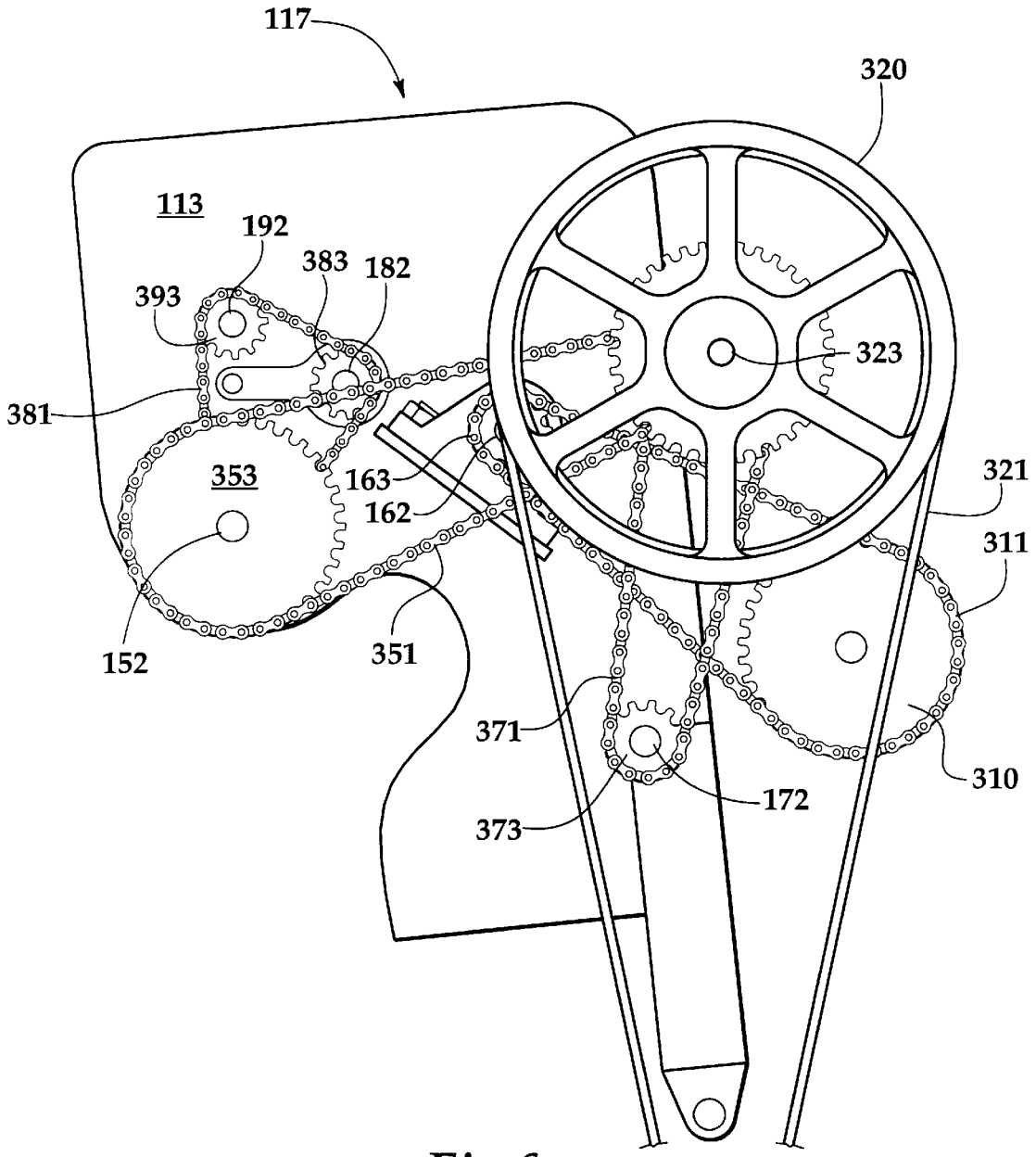
FIG. 6 is an end view illustrating the drive gears, chains and belts of the gin of the present invention.

Referring now to FIG. 6, therein is illustrated the drive system for the components of the present invention as seen from the opposite end illustrated in FIGS. 2A, 3 and 4. A two horsepower motor 400 (shown in FIG. 7) drives sprocket 310 which, by means of chain 311, drives sprocket 163 mounted on shaft 162 of seed roll agitator 160. The remaining moving elements of the ginning breast 117 are driven by a 50 HP motor (not shown) connected to a slave pulley 320 by belt 321. The slave pulley 320 is connected to a shaft 323 containing two additional sprockets (not shown). A first sprocket drives chain 371 which in turn drives sprocket 373 mounted on shaft 172 of feeder roller 170. A second sprocket drives chain 351 which in turn drives sprocket 353 mounted on shaft 152 of rotary rib 150. A second sprocket (not shown) mounted on shaft 152 drives chain 381 which drives sprocket 383 mounted on shaft 182 of twelve star roller 180 and sprocket 393 mounted on shaft 192 of sweeper brush 190. The gin saw shaft 122 is also driven by the 50 HP motor by a drive system not illustrated herein. It will be understood by those skilled in the art that the size of the drive sprockets may be adjusted to vary the speed of the various rotating elements of the present invention.

Figure 7:
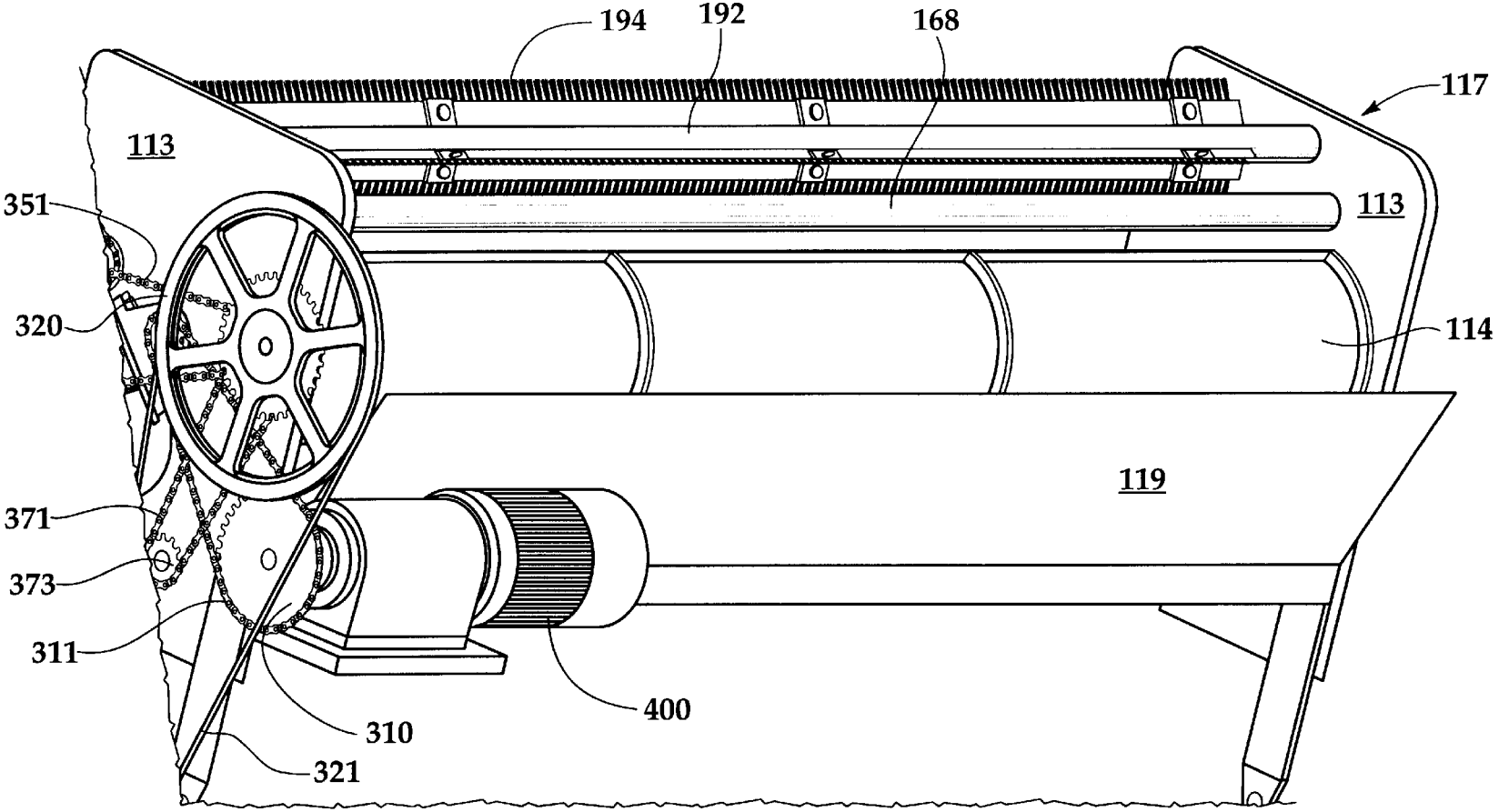
FIG. 7 is a perspective view of the rotary rib gin of the present invention with the ginning breast rotated in contact with the gin saws in the operating position.

Referring to FIG. 7, therein is illustrated a perspective view of the rotary rib gin 100 of the present invention with the ginning breast 117 rotated in contact with the gin saws 120 in the operating position. The inlet cotton chute 116 is rotated up for viewing a portion of the components of the gin 100. The perspective view of FIG. 7 is taken from the opposite end of the gin stand 12 as illustrated in FIGS. 2A, 2B, 3 and 4. Feeder chute 116 is rotated down in contact with feeder tray 119. Seed roll box 114 is illustrated in a closed position. The sweeper brush 190 sweeps trash T carried by the twelve star roller 180 (not shown) over the press roller 168 back into the seed roll box 114.

It will be understood by those skilled in the art that the diameter sizes and the rotational speeds of the various elements of the present invention may be varied without departing from the scope of the present invention. Although a preferred embodiment of the invention has been illustrated in the accompanying Drawings and described in the foregoing Detailed Description, it will be understood that the invention is not limited to the embodiment disclosed but is capable of numerous modifications without departing from the scope of the invention as claimed.

We claim:

1. A cotton gin comprising:

a plurality of gin saw blades axially spaced and mounted on a rotatable shaft, said shaft rotatably mounted in a gin stand;

a ginning breast pivotally mounted on said gin stand, said ginning breast including:

a plurality of stationary ribs having:

a lower end fixed to the ginning breast, and an upper free end, wherein the free end of a stationary rib is in an operating position;

a rotary rib rotatably mounted in the ginning breast above the free end of the stationary ribs, said rotary rib comprising:

a plurality of axially spaced rotary discs fixably mounted on a rotatable shaft, wherein an end portion of each rotary disc is disposed between each adjacent gin saw blade when the ginning breast is in an operating position; and a star roller rotatably mounted in the ginning breast adjacent the rotary rib, said star roller comprising a plurality of axially spaced discs, each disc with a plurality of points, said discs fixably mounted on a rotatable shaft, wherein the point portion of each of said discs is disposed between each adjacent rotary rib disc.

2. The cotton gin of claim 1 further including a sweeper brush rotatably mounted in the ginning breast adjacent the star roller, said sweeper brush comprising at least one brush longitudinally mounted to a rotatable shaft, wherein a tip portion of bristles of the brush contacts the adjacent star roller for sweeping trash therefrom.

3. A cotton gin comprising:

a plurality of gin saw blades axially spaced and mounted on a rotatable shaft, said shaft rotatably mounted in a gin stand;

a ginning breast pivotally mounted on said gin stand, said ginning breast including:

a plurality of stationary ribs having:

a lower end fixed to the ginning breast, and an upper free end, wherein the free end of a stationary rib is disposed between each adjacent gin saw blade when the ginning breast is in an operating position;

a rotary rib rotatably mounted in the ginning breast above the free end of the stationary ribs, said rotary rib comprising:

a plurality of axially spaced rotary discs integrally formed on a rotatable shaft, each of said rotary discs separated by a circumferential slot, wherein an outer edge of a gin saw blade is disposed in each slot between each adjacent rotary rib disc when the ginning breast is in the operating position; and a star roller rotatably mounted in the ginning breast adjacent the rotary rib, said star roller comprising a plurality of axially spaced discs, each with a plurality of points, said discs mounted on a rotatable shaft, wherein the point portion of each of the discs is disposed in the slot between each adjacent rotary rib disc.

4. The cotton gin of claim 3 further including a sweeper brush rotatably mounted in the ginning breast adjacent the star roller, said sweeper brush comprising at least one brush longitudinally mounted to a rotatable shaft, wherein a tip portion of bristles of the brush contacts the adjacent star roller for sweeping trash therefrom.

* * * * *

UNITED STATES PATENT AND TRADEMARK OFFICE

CERTIFICATE OF CORRECTION

PATENT NO. : 6,108,872
DATED : August 29, 2000
INVENTOR(S) : Mark Nichols, et al.

It is certified that error appears in the above-identified patent and that said Letters Patent is hereby corrected as shown below:

Specification,
Section 1, line 39, change "3,315,021" to -- 3,135,021 --.

Signed and Sealed this

Second Day of October, 2001

*Attest:*

Nicholas P. Godici

*Attesting Officer*

NICHOLAS P. GODICI
*Acting Director of the United States Patent and Trademark Office*